US005290023A

United States Patent [19]

Sasaki et al.

[11] Patent Number: 5,290,023

[45] Date of Patent: Mar. 1, 1994

[54] SHEET FEEDER FOR SHEET-FED PRESS

[75] Inventors: Masamichi Sasaki; Yoshinori Honkawa, both of Fuchu, Japan

[73] Assignee: Ryobi Limited, Hiroshima, Japan

[21] Appl. No.: 923,363

[22] Filed: Jul. 31, 1992

[30] Foreign Application Priority Data

Aug. 23, 1991 [JP] Japan ..... 3-212000

[51] Int. Cl.[5] ..... B65H 3/30

[52] U.S. Cl. ..... 271/20; 271/104; 271/105; 271/106

[58] Field of Search ..... 271/19, 20, 104, 105, 271/106, 121

[56] References Cited

U.S. PATENT DOCUMENTS

| | | | |
|---|---|---|---|
| 3,861,668 | 1/1975 | Wood | 271/105 X |
| 4,397,459 | 8/1983 | Silverberg et al. | 271/105 X |
| 5,110,110 | 5/1992 | Wirz et al. | 271/105 X |
| 5,150,892 | 9/1992 | Shimizu | 271/106 X |

FOREIGN PATENT DOCUMENTS

| | | | |
|---|---|---|---|
| 324562 | 1/1930 | United Kingdom | 271/105 |

*Primary Examiner*—H. Grant Skaggs
*Assistant Examiner*—Carol Lynn Druzbick
*Attorney, Agent, or Firm*—Darby & Darby

[57] ABSTRACT

There is provided a sheet feeder for a sheet-fed press which allows an optimum separation state of printing sheets 27 to be established readily and certainly. Air is jetted out from an injection nozzle 6 toward the upper part of a bundle 2 of printing sheets to thereby float up printing sheets 27. A top printing sheet 27 thus floated is absorbed by an absorption foot 8 and conveyed to a printing process. The number of floating printing sheets 27 is detected using photoelectric sensors 21 and 22, and in order to establish the optimum separation state, is adjusted by varying the injection air quantity from the injection nozzle 6 or by moving the paper pressure bar 4 in directions of arrows 93 and 94. Further, by equalizing outputs G1 and G2 from detection areas M1 and M2, it is possible to place the top printing sheet 27 in parallel with the absorption surface 8Q of the absorption foot 8 and realize secure absorption. A fuzzy inference system may be used for adjustment.

12 Claims, 16 Drawing Sheets

MEMBERSHIP FUNCTION FOR OUTPUTS G1 AND G2 OF SENSORS 21 AND 22.

MEMBERSHIP FUNCTION FOR OPENING RATIO V OF FLOW RATE CONTROL VALVE.

MEMBERSHIP FUNCTION FOR POSITION L OF PAPER PRESSURE BAR.

SHEET FEEDER FOR SHEET-FED PRESS

BACKGROUND OF THE INVENTION

1. Field of the Invention

The present invention relates to a sheet feeder for conveying and supplying with a printing sheet to a printing process and, more particularly, to a sheet feeder for a sheet-fed press which can feed a printing sheet accurately and readily without defective feeding.

2. DESCRIPTION OF THE PRIOR ART

A conventional sheet feeder for a sheet-fed press will be outlined in accordance with FIG. 1A. A bundle 2 of printing sheets comprising a lot of printing sheets 27 piled up is placed on a loading base 9. These printing sheets 27 are successively conveyed, one by one from the upper end of the bundle 2, to a printing process, where they are subjected to a prearranged printing process.

It sometimes occurs that a plurality of printing sheets 27 are made to adhere due to electrostatic force or the like. Such a case may result in feeding two or more printing sheets 27, obstructing the subsequent printing process. In order to prevent such two sheets feeding and feed exactly only one sheet to the printing process, the following way has been adopted.

As shown in the figure, an injection nozzle 6 is provided near the upper side edge of the bundle 2 to thereby jet air toward the bundle 2 of printing sheets. Owing to jets of air, several to several tens of printing sheets 27 constituting the upper part of the bundle 2 are forced to float and separate from the remaining part of the bundle 2, thus separate printing sheets 10 are formed. As described above, by separating printing sheets 27 into independent pieces, it is possible to relieve two sheets feeding due to electrostatic force or the like. Further, a sheet separator 12 is attached on top of the injection nozzle 6, allowing a top sheet of separate printing sheets 10 to be caught thereby. This serves to set limits to the floating height of printing sheets 27, so then the top printing sheet 27 is kept in a fixed position.

In addition, a paper pressure bar 4 for applying pressure on printing sheets 27 is provided on top of the bundle 2. Provision of the paper pressure bar 4 is intended to apply pressure on printing sheets 27 in the width direction from side to side and thereby block jets of air. By the presence of the paper pressure bar 4, it is possible to efficiently send the air from the injection nozzle 6 into every spaces of each adjoining printing sheets 27 and form separate printing sheets 10. Incidentally, the paper pressure bar 4 is unrestrictedly movable in directions of arrows 93 and 94. Also, at every moment when the printing sheet 27 is conveyed, the paper pressure bar 4 periodically rises in the direction of an arrow 95 so as not to impede sheet conveyance.

An absorption foot 8 is provided close over separate printing sheets 10, as shown in the figure. First, the absorption foot 8 lowers in the direction of an arrow 92 and holds the top printing sheet 27 of separate printing sheets 10 by absorbing it. Then, the absorption foot 8 rises in the direction of an arrow 91 and thereafter moves in the direction of the arrow 93, thus conveying the printing sheet 27 to the prearranged printing process. Incidentally, the loading base 9 is made to lift according as printing sheets 27 are fed to decrease.

If the top printing sheet 27 of separate printing sheets 10 is not floated up to the position of the sheet separator 12, the absorption foot 8 cannot absorb the printing sheet 27. Further, even in the case where the top printing sheet 27 is extended to the sheet separator 12, if too many printing sheets 27 are made to float up, floating sheets are closed to each other and adhered due to electrostatic force or the like. This is responsible for two sheets feeding. Therefore, it is desired as optimum separation state that the top printing sheet 27 is extended to the position of the sheet separator 12 with every floating sheets moderately separated.

However, the optimum separation state becomes different according to sheet thickness, sheet quality or the like. Consequently, in sheet feeding, it has been necessary to establish the optimum separation state in compliance with the printing sheet 27 involved. The optimum separation state is established by adjusting the injection air quantity from the injection nozzle 6 or by moving the paper pressure bar 4 in directions of arrows 93 and 94, with the state of separation visually inspected at the same time.

However, the conventional sheet feeder for a sheet-fed press has the following problems. Establishing the optimum separation state of the printing sheet 27 to be processed is conducted by adjusting injection air quantity or by moving the paper pressure bar 4 with the aid of manual operation of a worker. Printing sheets 27 are allowed to float up to higher position by increasing the injection air quantity from the injection nozzle 6, whereas the floating height is made to lower when the injection air quantity from the injection nozzle 6 is decreased. Also, moving the paper pressure bar 4 in the direction of the arrow 94 causes air to be jetted over a wide range of each printing sheet 27, with the result that printing sheets 27 are floated up to higher position. On the other hand, if it is moved in the direction of the arrow 93, the floating height of printing sheets 27 becomes low.

As described above, by adjusting injection air quantity, moving the paper pressure bar 4, or combining these two operations while visually inspecting the state of separation at the same time, a worker, through trial and error, establishes the optimum separation state. The operation of adjustment, therefore, takes a lot of time and also requires a skill, leading to the problem that the optimum separation state is not readily established.

In addition, even if the optimum separation state is established before starting sheet feeding as described above, it sometimes turns ill-suited in the course of sheet feeding because of the change in printing speed in printing or the rise of the loading base 9. As a result, the problem of defective sheet feeding such as feeding two printing sheets 27 or the like may occur.

An additional problem is as follows. As shown in FIG. 1B, printing sheets 27 sometimes curl due to, for example, sheet property, or the effect of printing ink parched after they are subjected to printing. In such a case, the absorption foot 8 cannot securely absorb the printing sheet 27, because the printing sheet 27 and an absorption surface 8Q of the absorption foot 8 are not placed in parallel with one another. Correcting the position of such printing sheets 27 is more difficult as compared with ordinary adjustment.

OBJECTS AND SUMMARY OF THE INVENTION

An object of the present invention, therefore, is to overcome the aforementioned problems and provide a sheet feeder for a sheet-fed press which allows an optimum separation state of printing sheets involved to be established readily and certainly.

According to a feature of the invention, there is provided a sheet feeder for a sheet-fed press comprising:

a loading base for loading a bundle of printing sheets made up of a plurality of printing sheets piled up;

an air injection unit which injects air to thereby make an upper part of the bundle of printing sheets float up and separate;

a conveyance unit which conveys a top sheet of separate printing sheets to a printing process by holding the top sheet using a contact surface;

at least two separation state detectors which emit light beams onto at least two areas of a thick side face to sense respective reflected light beams therefrom and output corresponding separation state sensed signals, the thick side face being a side face of separate printing sheets separated by air injection and is situated almost in parallel with the contact surface of the conveyance unit;

an optimum separation state value storage means for storing a preset optimum separation state value of printing sheets;

an adjust means which is given the at least two separation state sensed signals and the optimum separation state value and outputs an injection air quantity adjusting signal in order that the separation state sensed signals become almost the same as the optimum separation state value; and an injection air quantity controller which is given the injection air quantity adjusting signal and adjusts the injection air quantity from the air injection unit.

According to a further feature of the invention, there is provided a sheet feeder for a sheetfed press comprising:

a loading base for loading a bundle of printing sheets made up of plurality of printing sheets piled up;

an air injection unit which injects air to thereby make an upper part of the bundle of printing sheets float up and separate;

a pressure unit which is placed on top of the bundle of printing sheets to apply pressure thereon, being situated almost perpendicular to a direction of the air from the air injection unit and is movable in such a direction that is almost identical with that of air injection;

a conveyance unit which conveys a top sheet of separate printing sheets to a printing process by holding the top sheet using a contact surface;

at least two separation state detectors which emit light beams onto at least two areas of a thick side face to sense respective reflected light beams therefrom and output corresponding separation state sensed signals, the thick side face being a side face of separate printing sheets separated by air injection and is situated almost in parallel with the contact surface of the conveyance unit;

an optimum separation state value storage means for storing a preset optimum separation state value of printing sheets;

an adjust means which is given the at least two separation state sensed signals and the optimum separation state value and outputs a pressure position adjusting signal in order that the separation state sensed signals become almost the same as the optimum separation state value; and a pressure unit travel controller which is given the pressure position adjusting signal and makes the pressure unit move in such a direction that is almost identical with that of air injection.

According to a still further feature of the invention, there is provided a sheet feeder for a sheetfed press comprising:

a loading base for loading a bundle of printing sheets made up of a plurality of printing sheets piled up;

an air injection unit which injects air to thereby make an upper part of the bundle of printing sheets float up and separate;

a pressure unit which is placed on top of the bundle of printing sheets to apply pressure thereon, being situated almost perpendicular to a direction of the air from the air injection unit and is movable in such a direction that is almost identical with that of air injection;

a conveyance unit which conveys a top sheet of separate printing sheets to a printing process by holding the top sheet using a contact surface;

at least two separation state detectors which emit light beams onto at least two areas of thick side face to sense respective reflected light beams therefrom and output corresponding separation state sensed signals, the thick side face being a side face of separate printing sheets separated by air injection and is situated almost in parallel with the contact surface of the conveyance unit;

an adjust means which executes fuzzy inference on the basis of the at least two separation state sensed signals and outputs an injection air quantity adjusting signal and a pressure position adjusting signal in order that printing sheets are made to separate in an optimum state;

an injection air quantity controller which is given the injection air quantity adjusting signal and adjusts the injection air quantity from the air injection unit; and a pressure unit travel controller which is given the pressure position adjusting signal and makes the pressure unit move in such a direction that is almost identical with that of air injection.

While the novel features of the invention are set forth in a general fashion, particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENT

Figure 1A:
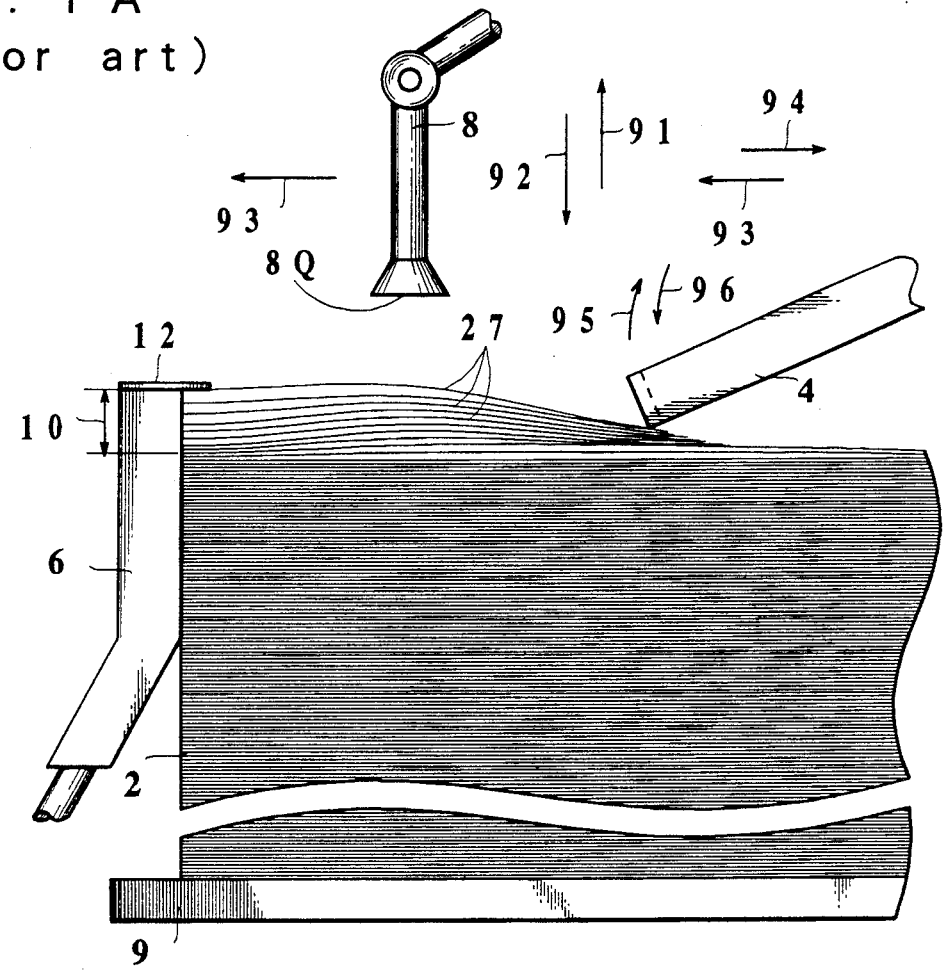
FIG. 1A (prior art)
FIG. 1 is a side view explanatory of a conventional sheet feeder.
Figure 2:
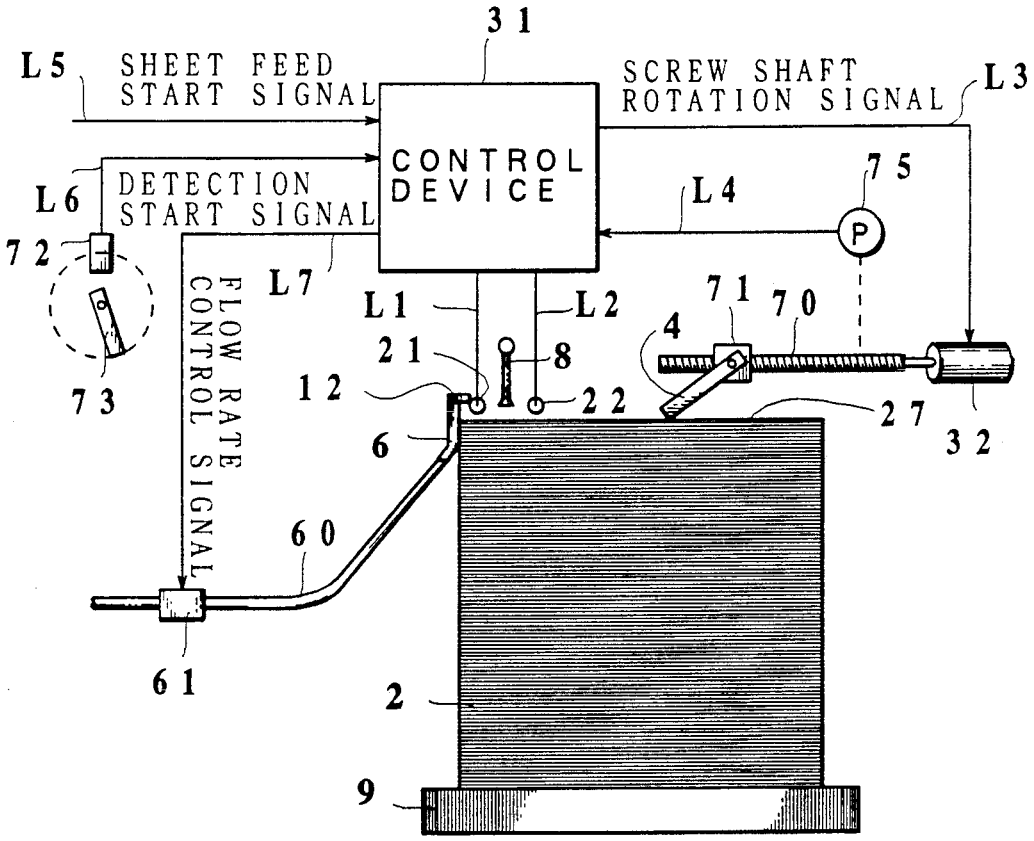
FIG. 2 is a diagram showing the general structure of a sheet feeder for a sheet-fed press which is an embodiment of the present invention.
Figure 3:
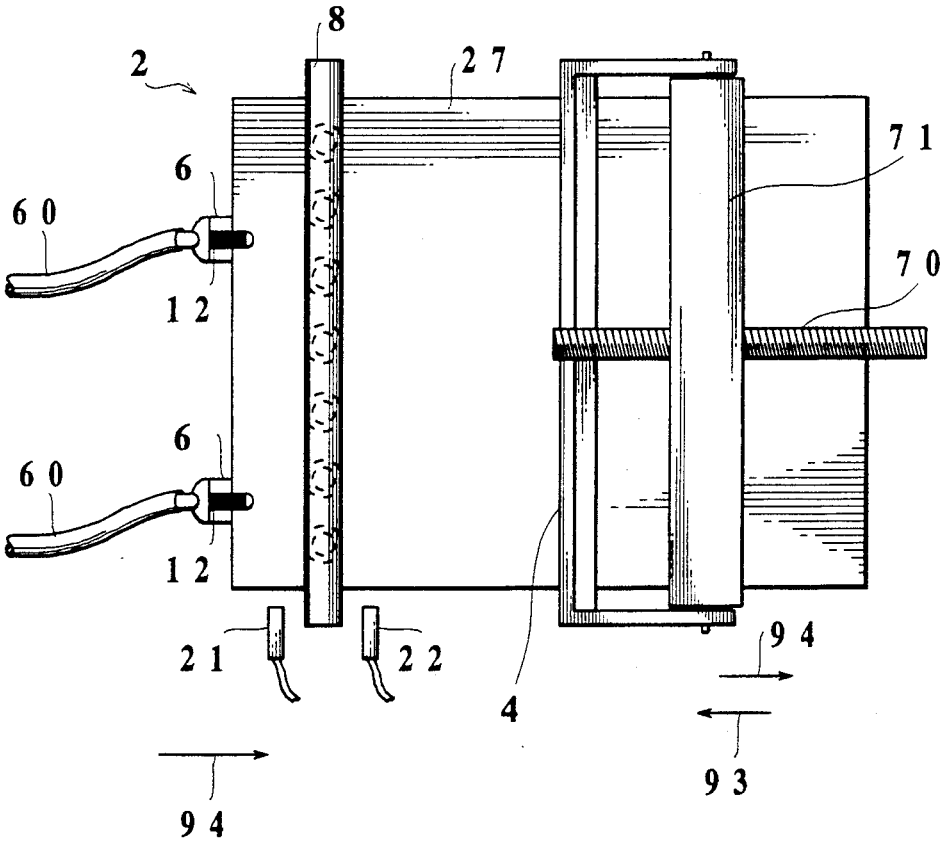
FIG. 3 is a plane view near bundle of printing sheets in the sheet feeder for a sheet-fed press shown in FIG. 2.

A sheet feeder for a sheet-fed press which is an embodiment of the present invention will be explained in accordance with drawings. First, the general structure of a sheet feeder for a sheet-fed press is shown in FIG. 2. A bundle 2 of printing sheets comprising a lot of printing sheets 27 piled up is placed on a loading base 9. These printing sheets 27 are successively conveyed, one by one from the upper end of the bundle 2, to a printing process, where they are subjected to a prearranged printing process. The sheet is conveyed by an absorption foot 8 as conveyance unit, which moves as designated and absorbs printing sheets 27 (see FIG. 1A). FIG. 3 shows a plane view including the bundle 2 of printing sheets, the absorption foot 8, or the like.

An injection nozzle 6 as air injection unit jets air out in order to prevent printing sheets 27 from adhering to each other due to electrostatic force or the like, and resulting two sheets feeding. The air injection allows the upper part of printing sheet 27 to be floated up to form separate printing sheets 10 (see FIG. 1A). A sheet separator 12 is provided on top of the injection nozzle 6 to set limits to the floating height of printing sheets 27 by catching the top printing sheet 27 (see FIG. 1A).

Injection air is supplied through an air hose 60. The air hose 60 is provided with a flow rate control valve 61 as injection air quantity controller, which serves to adjust air supply or the quantity of injection air from the injection nozzle 6 by closing and opening. Here, the flow rate control valve 61 varies injection air quantity according to a flow rate control signal as injection air quantity adjusting signal transmitted from a control device 31 via a line L7.

Also, a paper pressure bar 4 as pressure unit for applying pressure on printing sheets 27 is placed on the bundle 2 of printing sheets. As shown in FIG. 3, the paper pressure bar 4 is placed almost perpendicular to the direction of jets of air from the injection nozzle 6 (arrow 94). Provision of the paper pressure bar 4 is intended to block air from the injection nozzle 6 using a pressurized line to thereby efficiently float up each printing sheet 27.

The paper pressure bar 4 is fixed to a paper pressure bar fixing block 71 and is unrestrictedly movable in directions of arrows 93 and 94 by rotating a screw shaft 70. To be more precise, the screw shaft 70 is screwed to penetrates through the paper pressure bar fixing block 71 and moves back and forth correspondingly to the direction and number of rotation thereof. The screw shaft 70 is driven by a driving motor 32 as pressure unit travel controller and is controlled by a screw shaft rotation signal as pressure position adjusting signal given by the control device 31 through a line L3. Further, a potentiometer 75 obtains the number of rotation of the screw shaft 70 through a line L4 to thereby detect the position of the paper pressure bar 4.

Figure 1B:
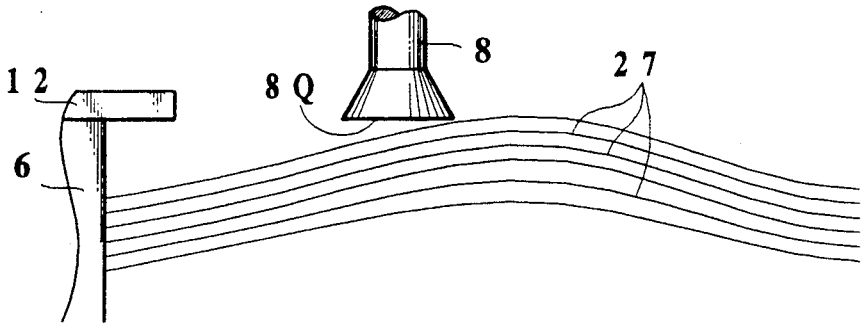
FIG. 1B (prior art)

Also, the paper pressure bar 4 periodically rises in the direction of an arrow 95 at every moment when the printing sheet 27 is fed (see FIG. 1). This is to prevent the paper pressure bar 4 from applying pressure when the absorption foot 8 conveys the printing sheet 27 to the printing process. After conveying a top sheet of printing sheets 27, therefore, it lowers in the direction of an arrow 96 and applies pressure on printing sheets 27 again.

A proximity switch 72 shown in FIG. 2 outputs a detection start signal to the control device 31 via a line L6 in the proportion of one signal to one rotation of a printing device. The output is performed whenever the proximity switch 72 detects a proximity cam 73 that is attached to a predetermined rotating part of the printing device. Incidentally, the detection start signal is output when the paper pressure bar 4 lowered is in the state of applying pressure on printing sheets 27.

Figure 6:
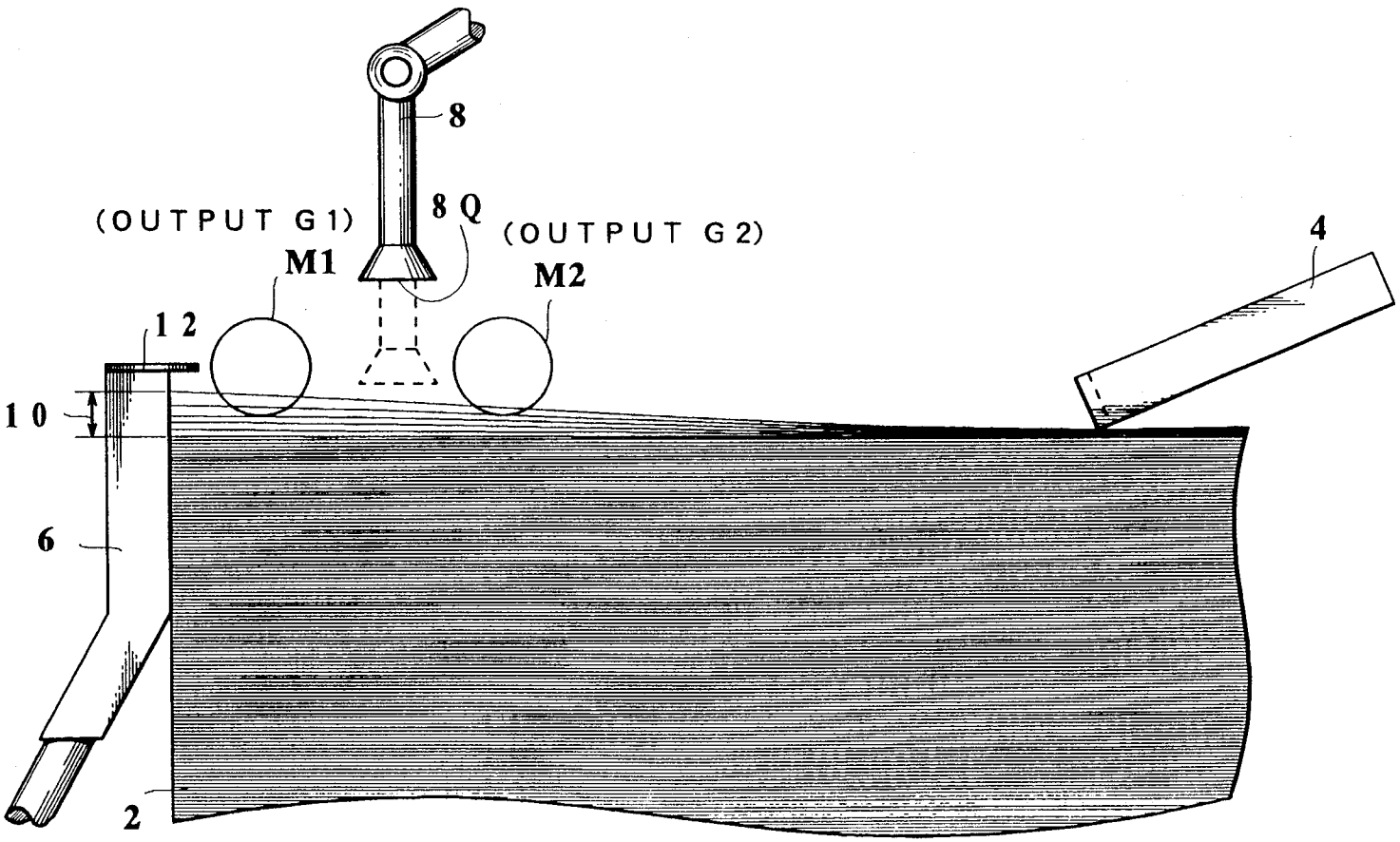
FIG. 6 is a side view showing the state of separate printing sheets of which floating height is low.

Photoelectric sensors 21 and 22 as separation state detector are provided in the vicinity of the absorption foot 8 or the sheet separator 12, as shown in FIG. 2. These photoelectric sensors 21 and 22 are reflection type sensors, each emitting light onto the side face made up of separate printing sheets 10 that is floated up with the aid of the injection nozzle 6. This state is shown in FIG. 6. Light beams from the photoelectric sensors 21 and 22 form detection areas Ml and M2 on the side face of separate printing sheets 10. Light projection is carried out in such a manner that these detection areas MI and M2 are almost in parallel with an absorption surface 8Q of the absorption foot 8.

The light beams emitted onto detection areas M1 and M2 reflect from the thick side face of printing sheets 27 to yield reflected light beams. Reflected light beams are sensed by respective photoelectric sensors 21 and 22, and then resulting outputs G1 and G2 as separation state sensed signal are given to the control device 31 via line L1 and L2. If there is a large number of printing sheets 27 present within detection areas Ml and M2, reflected light also increases with the result that much light sensed. On the contrary, if there is a small number of printing sheets 27 present, reflected light decreases with little light sensed.

Figure 4:
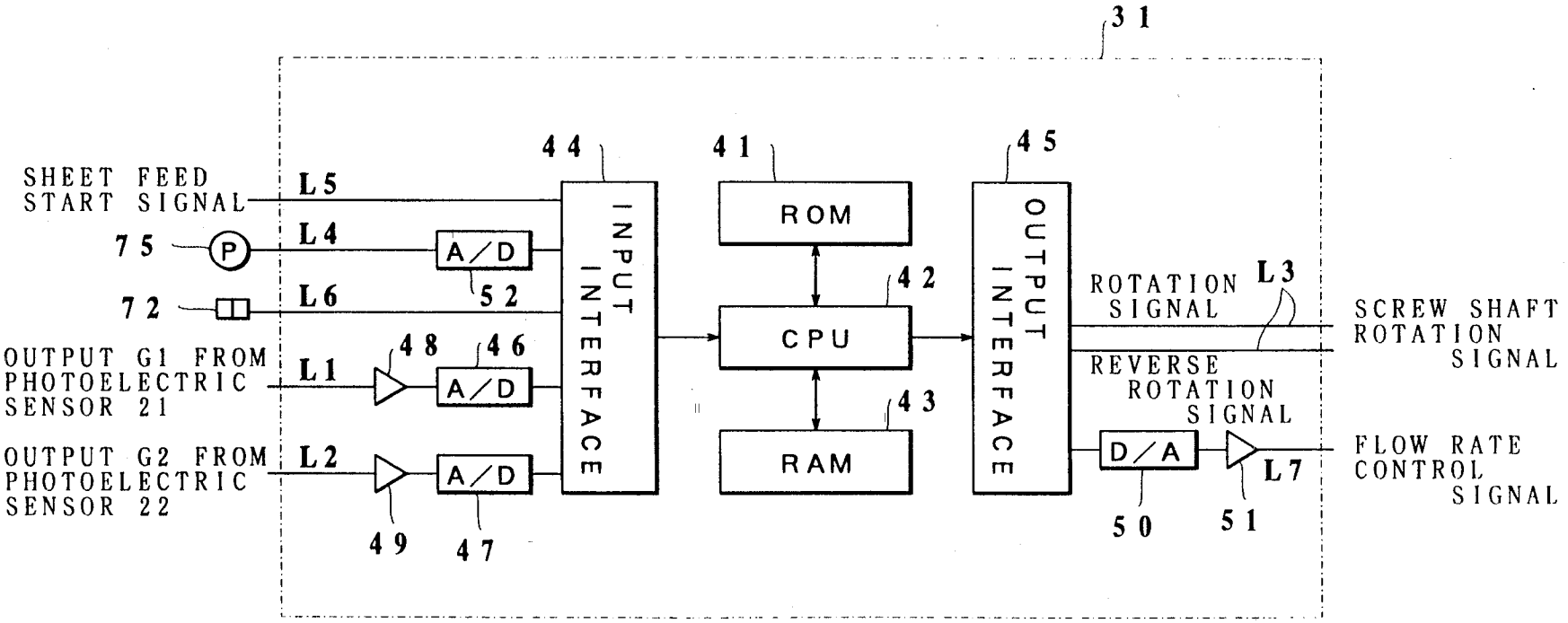
FIG. 4 is a block diagram showing the detailed structure of a control device in the sheet feeder for a sheet-fed press shown in FIG. 2.

The structure of the control device 31 will be explained in detail using FIG. 4. The control device 31 is provided with a ROM 41, a CPU 42, and a RAM 43. The CPU 42 controls each unit according to a program stored in the ROM 41. Lines Ll and L2 provided with amplifiers 48 and 49 and A/D converters 46 and 47, lines L5 and L6, and a line L4 provided with an A/D converter 52 are connected to an input interface 44. Further, a line L7 provided with a D/A converter 50 and an amplifier 51 and a line L3 are connected to an output interface 45. In addition, the line L3 transmits a rotation or reverse rotation signal as screw shaft rotation signal to the driving motor 32.

Figure 5:
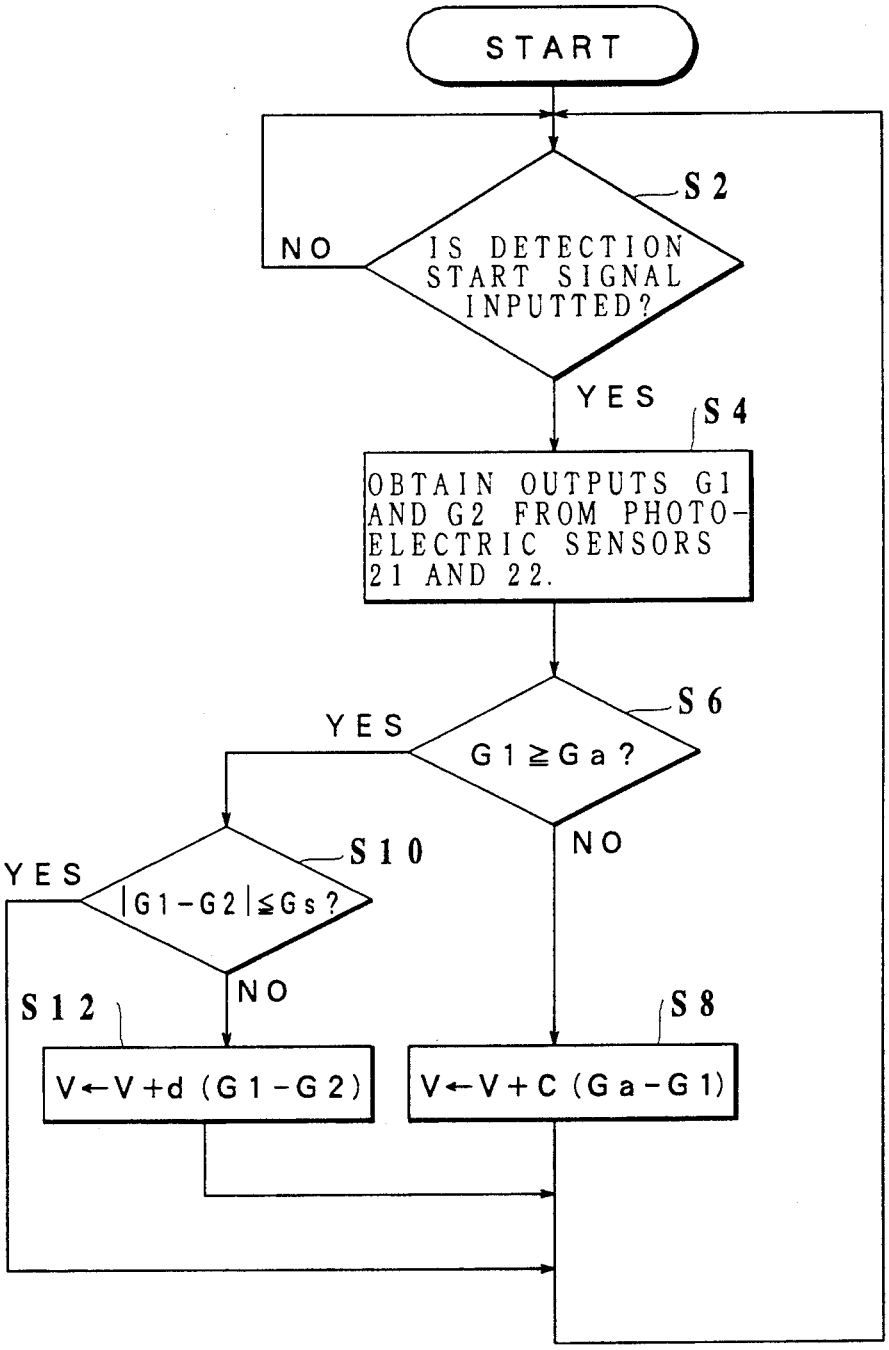
FIG. 5 is a flowchart which is an embodiment of a program stored in a ROM.

Next, actual operation of the sheet feeder according to the present invention will be explained in accordance with a flowchart of FIG. 5. The program, stored in the ROM 41, starts processing when a sheet feed start signal is given via the line 5 from the main body of the printing device (not shown). Also, with the initiation of processing, a flow rate control signal is given to the flow rate control valve 61 via the line L7, allowing air to be jetted out from the injection nozzle 6 by degrees.

First, the CPU 42 decides whether the detection start signal is given via the line L6 or not. If given, then go to a step S4 (step S2). At the step S4, outputs G1 and G2 from photoelectric sensors 21 and 22 are obtained through lines Ll and L2. It is decided whether the output G1 from the photoelectric sensor 21 is larger than a desired value Ga as optimum separation state value (step S6).

The desired value Ga mentioned above is the output to be output from the photoelectric sensor when separation is in the most favorable state. It must be preset and stored in the ROM 41 beforehand. Here, the most favorable state is such that the top sheet of separate printing sheets 10 is extended to the sheet separator 12, and at the same time, every floating sheets are moderately separated to the degree that they are free from electrostatic force or the like.

Immediately after air injection is initiated from the injection nozzle 6, injection air quantity is in a low level and a small number of printing sheets 27 is made to float, as shown in FIG. 6. Consequently, separate printing sheets 10 thus formed is not allowed to extend to the height of the sheet separator 12. For this reason, the output G1 from the photoelectric sensor 21 is smaller than the desired value Ga, so then, in FIG. 5, it is allowed to go to a step S8. In the step S8, V and C are an opening ratio of the flow rate control valve 61 and a predetermined constant, respectively. According to this step injection air quantity is made to increase by such a degree that is proportional to the difference between the desired value Ga and the output G1. Thus, the corresponding quantity of air is jetted out from the injection nozzle 6.

Figure 7:
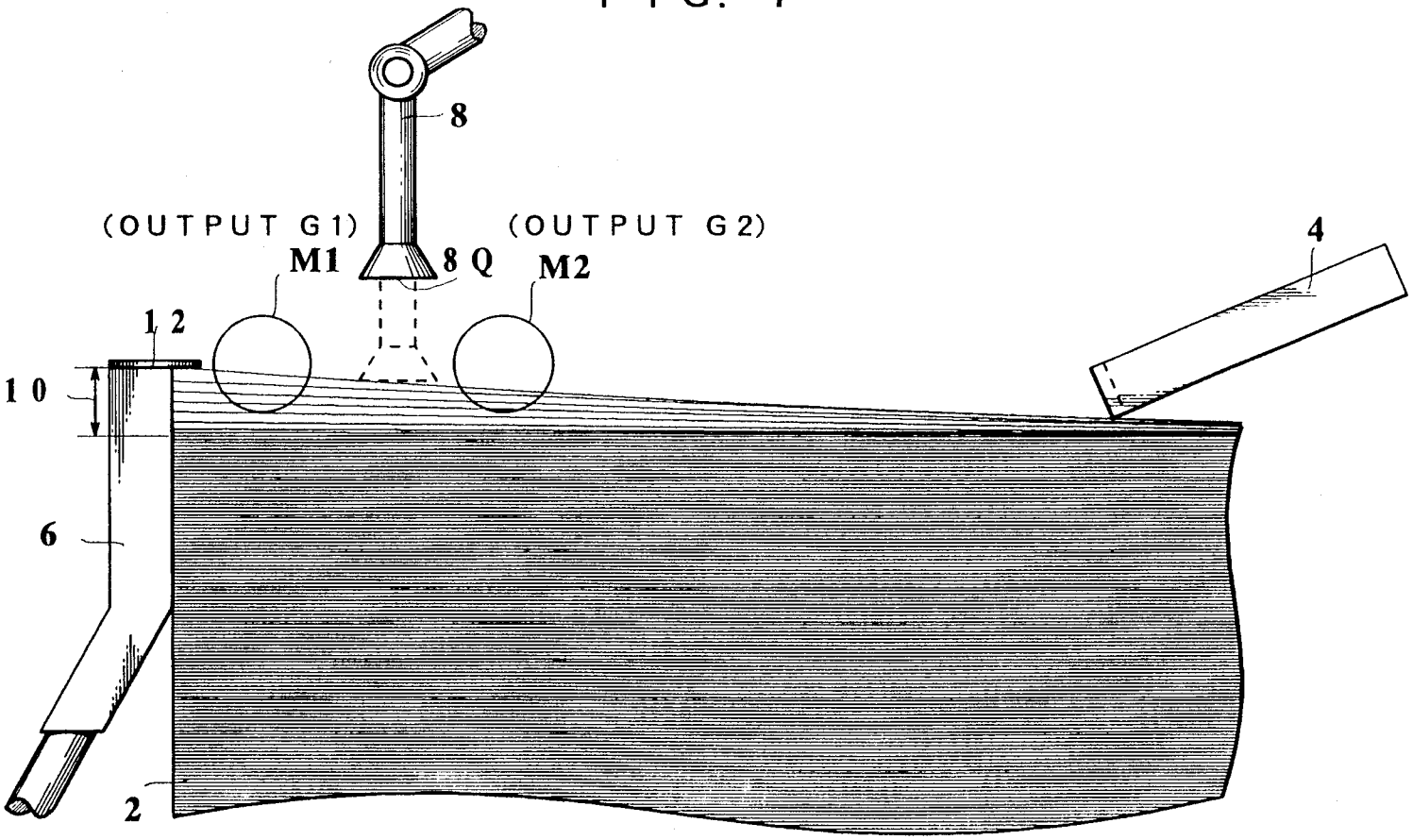
FIG. 7 is a side view showing the state of a top sheet of separate printing sheet which is not in parallel with an absorption foot.

The step S8 is repeated to the point where the output G1 becomes equal to the desired value Ga. In FIG. 7, there is shown the state in which the output G1 is equal to the desired value Ga. As known from the figure, due to rise in the quantity of injection air, the top printing sheet 27 is allowed to extend to the sheet separator 12 with every printing sheets 27 moderately separated. However, the top printing sheet 27 is not placed in parallel with the absorption surface 8Q of the absorption foot 8. In a case where the absorption surface 8Q is not in parallel with the printing sheet 27, the absorption foot 8 cannot securely absorb and hold the printing sheet 27.

Here, detection areas Ml and M2 are almost in parallel with the absorption surface 8Q. If outputs G1 and G2 are equalized by adjustment, the top printing sheet 27 may be placed in parallel with the absorption surface 8Q. Therefore, for the purpose of fine adjustment, in a step S10, an absolute value of the difference between outputs G1 and G2 is determined and then compared with an allowable preset value Gs which is set beforehand. The allowable preset value Gs is the allowable difference between outputs G1 and G2, namely, the allowable dislocation of the printing sheet 27 in parallelism within the range that the absorption foot 8 is capable of absorbing.

Figure 8:
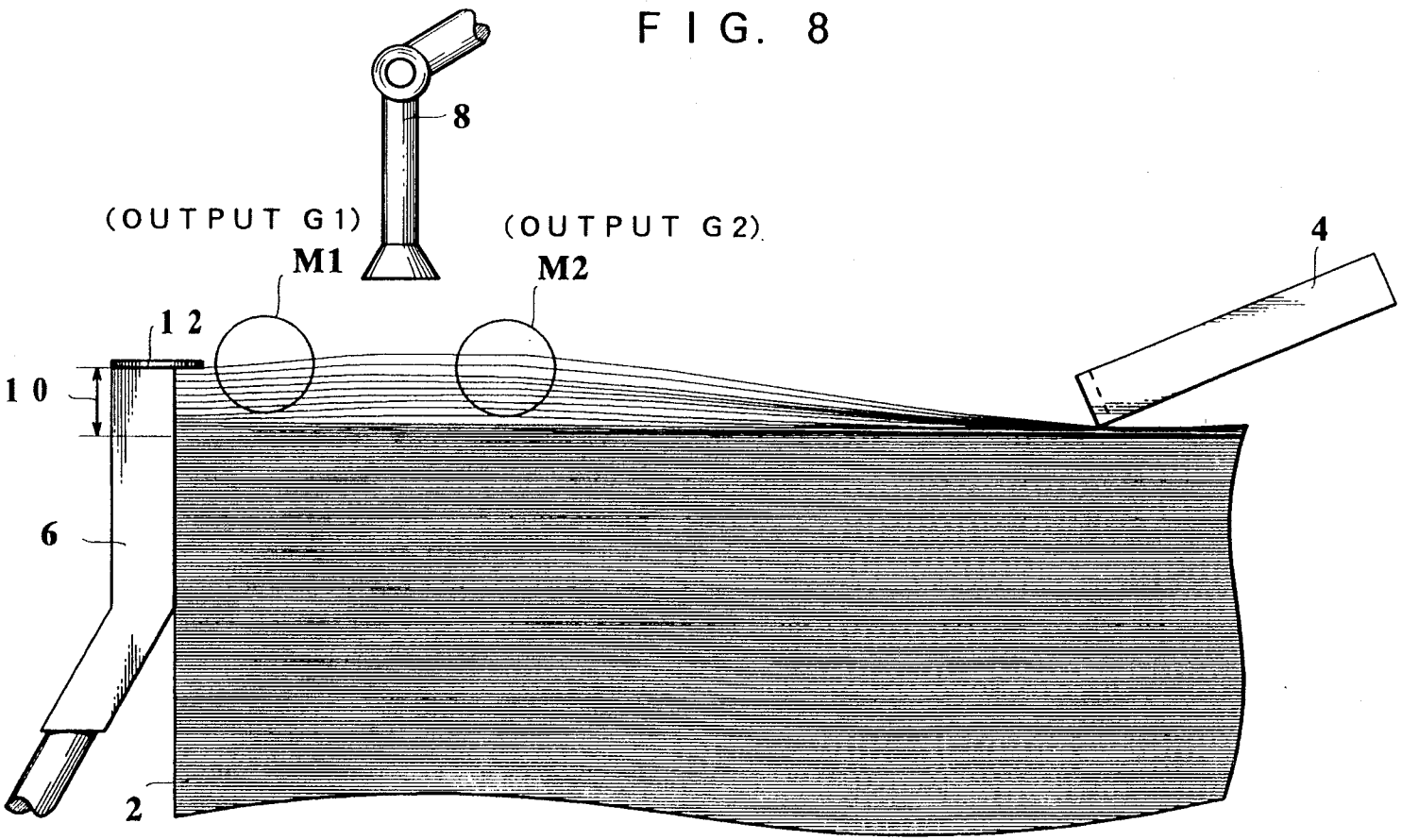
FIG. 8 is a side view showing the state of separate printing sheets of which floating height is high to excess.

In the step S10, if the absolute value of the difference between outputs G1 and G2 is not less than the allowable preset value Gs, then go to a step S12. In this step, the output difference (G1−G2) is multiplied by a constant d, allowing injection air quantity to be increased by the degree proportional to the difference (G1−G2). Moreover, if an excessive number of printing sheets 27 are made to float u to establish the state shown in FIG. 8 due to excess of air supply, the output G2 from the detection area M2 becomes greater than the output G1. In such a case, the difference (G1−G2) is determined as a negative value with the result that air supply is reduced.

Figure 9:
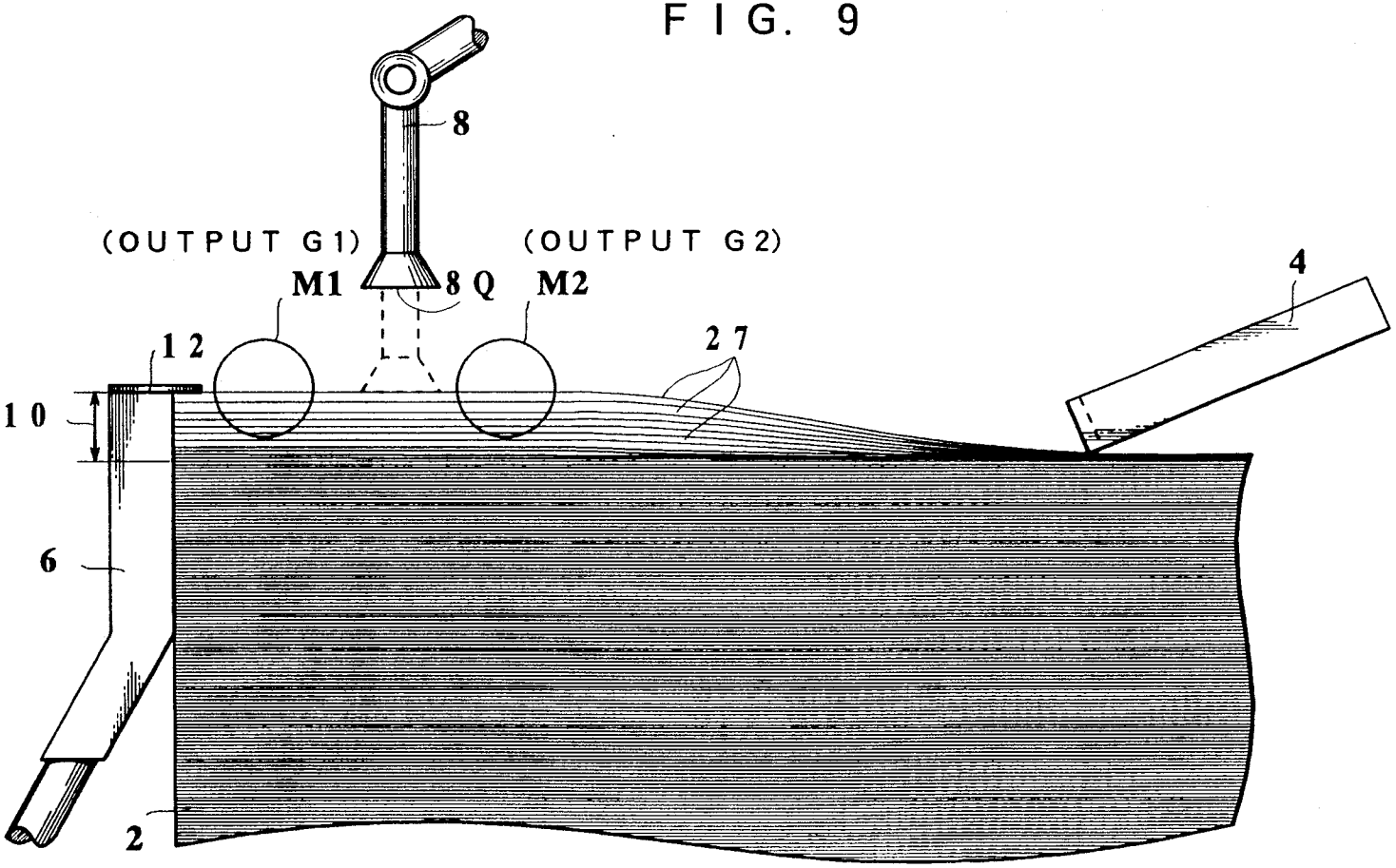
FIG. 9 is a side view showing the state of separate printing sheets formed in an optimum state and that of the top printing sheet placed in parallel with the absorption surface of an absorption foot.

Thus, there is provided the state of FIG. 9, in which separate printing sheets 10 are in the most favorable separation state and floating printing sheets are almost in parallel with the absorption surface 8Q of the absorption foot 8. Further, in this embodiment, adjustment is performed according to the detection start signal given for every single-rotations of a printing device (FIG. 5, step S2). Therefore, even if the initial optimum separation state turns ill-suited due to the change in rotating speed of the printing device, the rise of the loading base 9 (see FIG. 1A), or the like, adjustment is done immediately s then it is possible to maintain the optimum separation state at all times. Also, in a method for placing the printing sheet 27 almost in parallel with the absorption surface 8Q, it is possible that the output G2 may be directly compared with the desired value Ga for adjustment.

Figure 10:
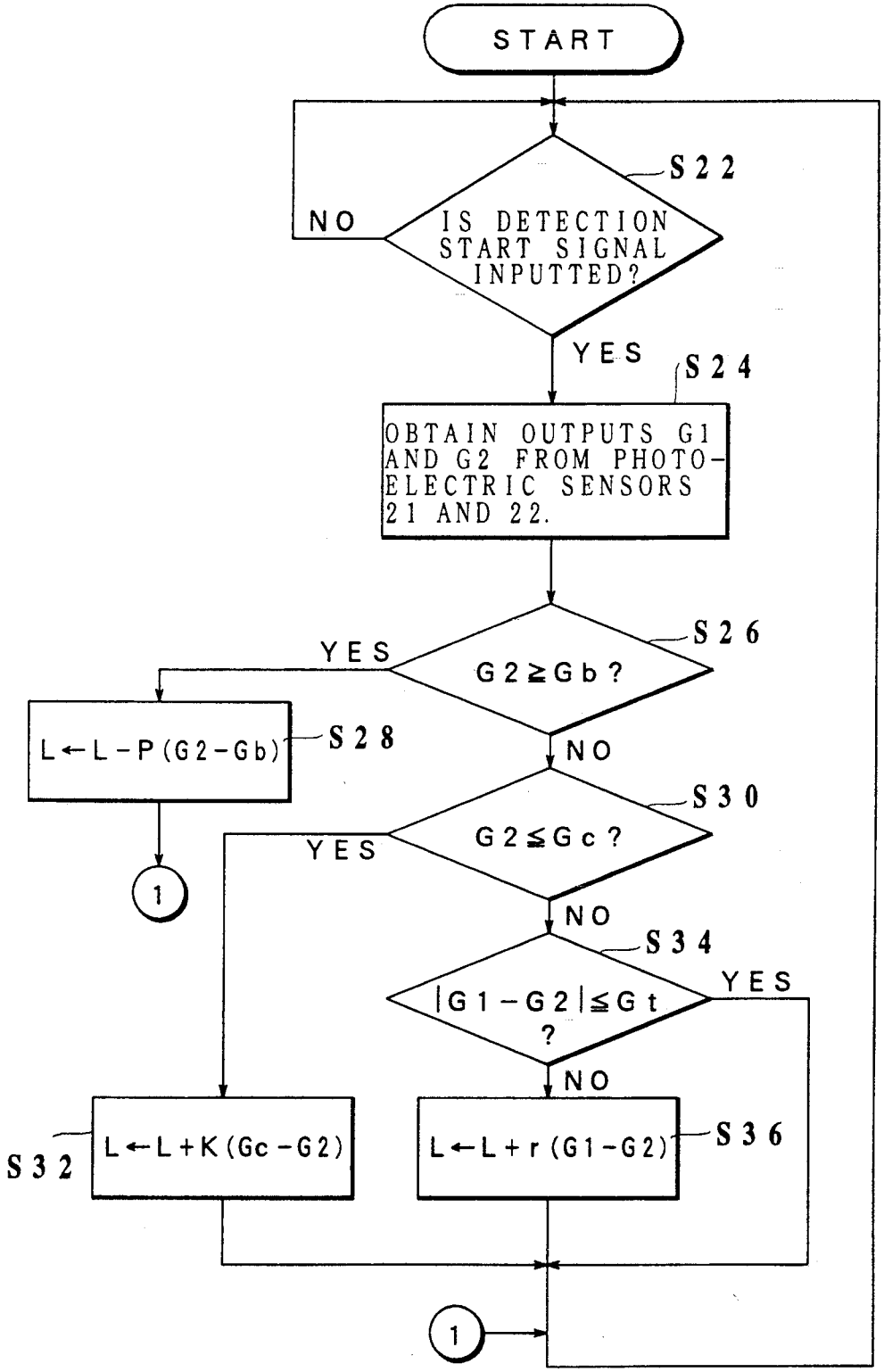
FIG. 10 is a flowchart which is another embodiment of a program stored in ROM.

Next, adjustment by moving the paper pressure bar 4 will be explained in another embodiment. In the following embodiment, it is assumed that air supply from the injection nozzle 6 is optimum for the printing sheet 27 having normal thickness. A flowchart for adjustment by moving the paper pressure bar 4 is shown in FIG. 10. In this embodiment, similarly processing is initiated according to the given detection start signal (step S22) and adjustment is performed at all times correspondingly to the rotation of the printing device. Outputs G1 and G2 from photoelectric sensors 21 and 22 are given to the CPU 42 via lines Ll and L2 (step S24). Thereafter, it is decided whether the output G2 from the photoelectric sensor 22 is not less than an upper limit Gb or not (step S26). The upper limit Gb is a maximum output allowable as output for the optimum separation state, being determined and stored beforehand.

Figure 11:
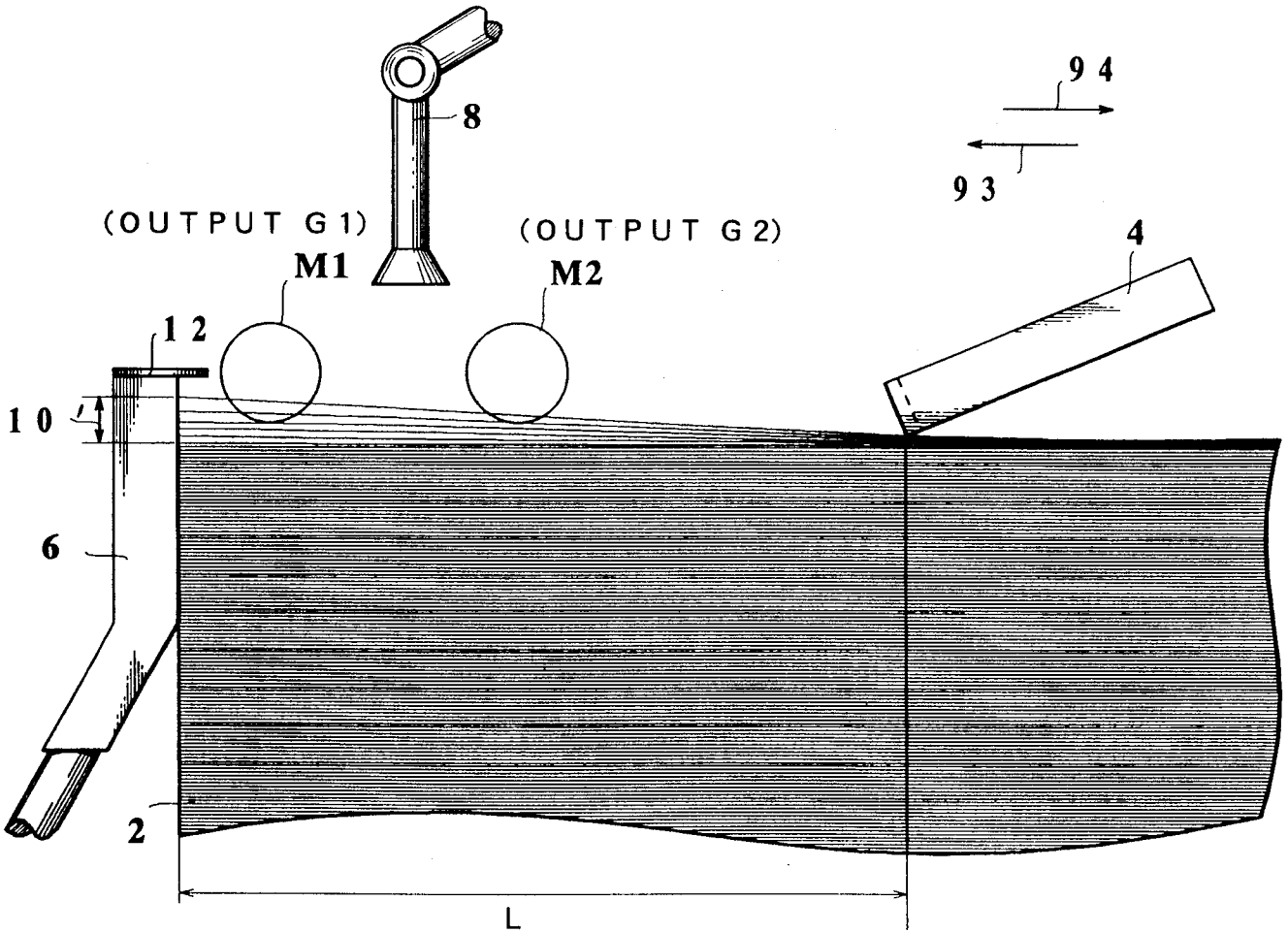
FIG. 11 is a side view showing the state of separate printing sheets of which floating height is low.
Figure 12:
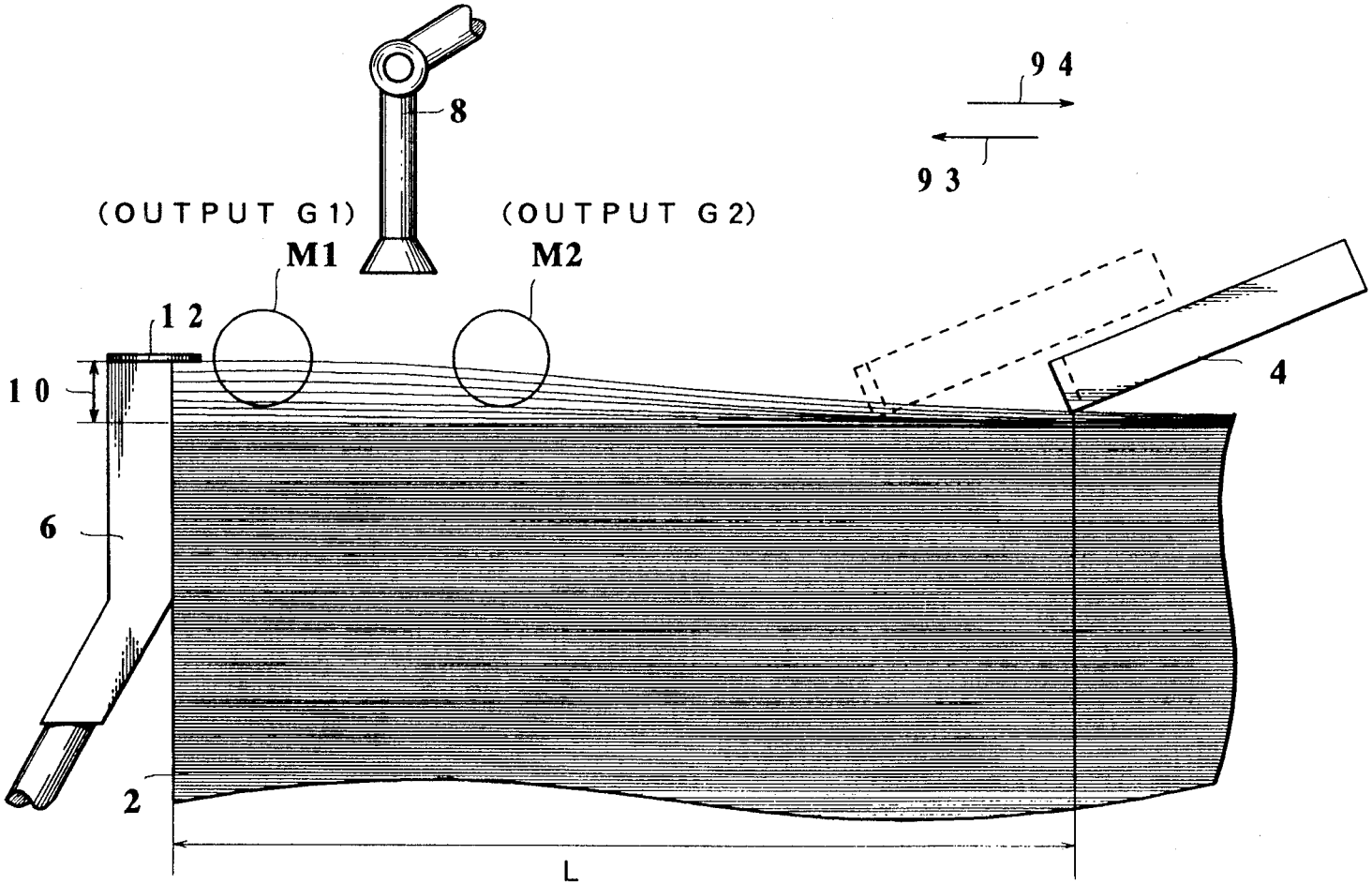
FIG. 12 is a side view showing the state of separate printing sheets in an optimum separation state which is established by moving the paper pressure bar in FIG. 11 backward.

Only when the output G2 is lower than the upper limit Gb, then go to a step S30. At this step, it is decided whether the output G2 is not exceeding a lower limit Gc or not. The lower limit Gc is a minimum output allowable as output for the optimum separation state. In FIG. 11, it is assumed that each printing sheet 27 is harder to bend and has heavier weight, because it has larger thickness than usual. Due to this, as shown in the figure, the top printing sheet 27 is incapable of extending to the sheet separator 12. The resulting output G2 for the detection area M2, therefore, is not exceeding the lower limit Gc.

If the output G2 is not exceeding the lower limit Gc as in the case described above, then go to a step S32. In this step S32, L is a distance from the paper pressure bar 4 to the injection nozzle 6. The difference between the lower limit Gc and the output G2, (Gc−G2), is determined, and then the paper pressure bar 4 moves in the direction of the arrow 94 by such a degree that is proportional to the determined difference. A character k is a preset constant. Because the paper pressure bar 4 moves backward, air is made to inject over a wide range of each printing sheet 27. As a result, as shown in FIG.

12, printing sheets 27 are made to float up, thus the optimum separation state can be established.

In the above-mentioned step S26, if the output G2 is not less than the upper limit Gb, namely when printing sheets 27 is high to excess, then go to a step S28. The paper pressure bar 4 moves in the direction of the arrow 93 by a corresponding degree (see FIG. 11). As a result of forward movement of the paper pressure bar 4, printing sheets 27 are made to lower to thereby establish the optimum separation state.

Thus, the optimum separation state can be established in the detection area M2. However, if printing sheets 27 in the detection area Ml are not in the optimum state, the printing sheet 27 cannot be placed in parallel with the absorption surface 8Q of the absorption foot 8. In such a case, at a step S34, it is decided whether the absolute value of the difference between outputs G1 and G2, (G1−G2), is not exceeding an allowable preset value Gt or not. The allowable preset value Gt is the allowable difference between outputs G1 and G2, namely, the allowable dislocation of the printing sheet 27 in parallelism within the range that the absorption foot 8 is capable of absorbing.

If the absolute value of the difference between outputs G1 and G2 exceeds the allowable preset value Gt, then go to a step 36. The output difference (G1−G2) is multiplied by a constant r, allowing the paper pressure bar 4 to be moved in the direction of the arrow 94 by the degree proportional to the output difference (G1−G2). Moreover, if printing sheets 27 are high to excess, the output G2 from the detection area M2 is greater than the output G1. In such a case, the difference (G1−G2) is determined as a negative value, with the result that the paper pressure bar 4 at the step S36 moves in the direction of the arrow 93 to apply pressure on printing sheets 27.

Figure 13:
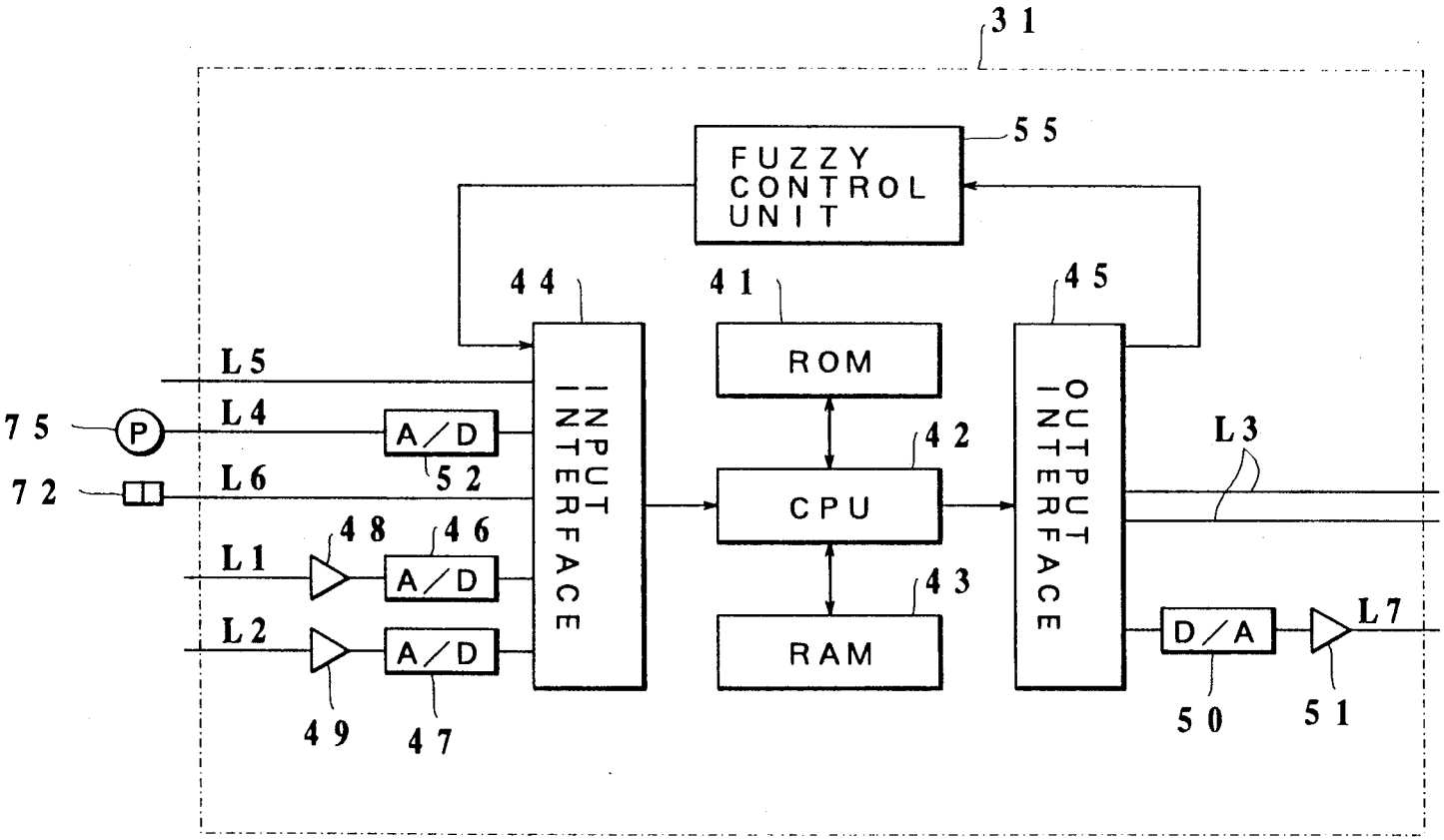
FIG. 13 is a block diagram showing the detailed structure of a control device according to another embodiment in which fuzzy control is adopted.

Next, adjustment using a fuzzy inference system will be explained in a further embodiment. In the following embodiment, adjustment is performed for both air supply and the position of the paper pressure bar 4. The control device 31 for use in fuzzy control is shown in block diagram in FIG. 13. The control device 31 is provided with a fuzzy control unit 55, whereto outputs G1 and G2 from photoelectric sensors 21 and 22 are given through the output interface 45.

The fuzzy control unit 55 may be a microcomputer programmed to execute fuzzy inference, or a specialized fuzzy controller. Further, the specialized fuzzy controller may be a digital type controller or an analog type controller. Moreover, instead of the fuzzy control unit 55, it is possible that the CPU 42, the ROM 41 and the RAM 43 may execute fuzzy inference and fuzzy control, wherein the ROM 41 stores predetermined rules and membership functions.

Figure 14A:
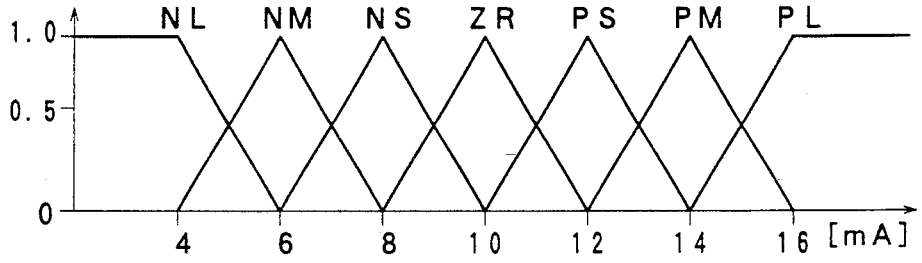
FIG. 14 is a diagram showing an embodiment of a membership function for use in a fuzzy inference system.
Figure 14B:
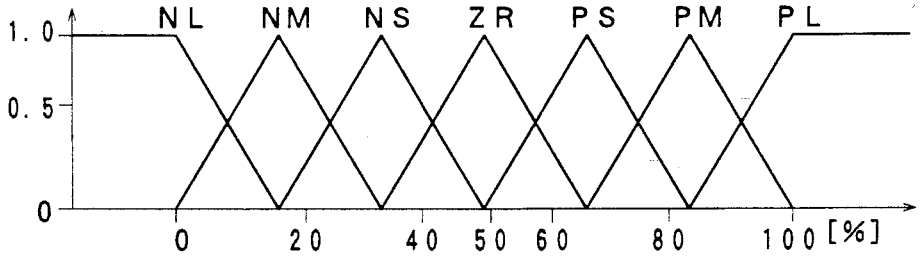
Figure 14C:
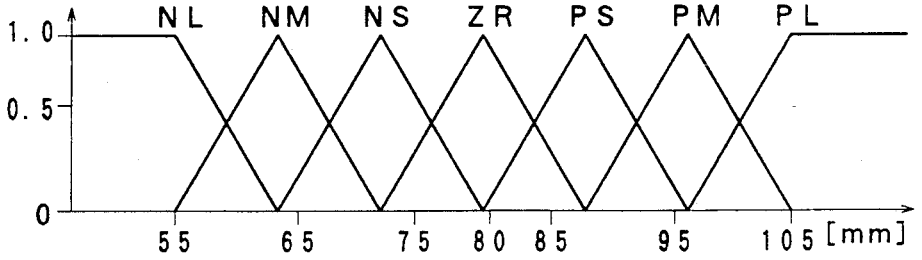

The fuzzy control unit 55 adjusts injection air quantity and the position of the paper pressure bar 4 on the basis of outputs G1 and G2 given and membership functions shown in FIGS. 14A-14C. This is carried out according to the following rules.

if G1=NS and G2=NL then V=PM <1> if G1=NS and G2=NL then L=PS <2>

In this rule, V is an opening ratio of the flow rate control valve 61, namely injection air quantity, and L is a distance from the injection nozzle 6 to the paper pressure bar 4, namely the position of the paper pressure bar 4. The rules and <2> mean that if the floating height of printing sheets 27 (output G1) is slightly low in the detection area Ml, and, at the same time, that (output G2) is extremely low in the detection area M2, then injection air quantity is made to increase up to a medium range, and the paper pressure bar 4 is made to move backward slightly.

if G1=PS and G2=PM then V=NS <3> if G1=PS and G2=PM then L=NS <4>

The rules <3> and <4> mean that if there is a slightly large number of floating printing sheets 27 (output G1) in the detection area Ml, and at the same time, the floating height of printing sheets 27 (output G2) is medium in the detection area M2, then injection air quantity is slightly made to decrease, and the paper pressure bar 4 is made to move forward slightly.

if G1=ZR and G2=ZR then V=ZR <5> if G1=ZR and G2=ZR then L=ZR <6>

The rules <5>and <6>mean that if separation state (output G1) is optimum in the detection area Ml, and at the same time, that (output G2) is also optimum in the detection area M2, then injection air quantity and the position of the paper pressure bar 4 are not changed.

Above-mentioned rules will be put into effect as follows. First, a rate at which the if part of each fuzzy rule is realized is determined using the membership function of FIG. 14A. Next, a rate at which the then part of each fuzzy rule is realized is determined and is applied to FIGS. 14B and 14C. In this embodiment, operations are performed using the so-called min-max method.

Thereafter, a center of gravity is determined by logical addition of then part membership functions to thereby decide the injection air quantity and the travel distance of the paper pressure bar 4. This means that the injection air quantity and travel distance of the paper pressure bar 4 are weighted to average on the basis of logical addition of the membership grade of then part of each membership function, whereby an actual injection air quantity and an actual travel distance of the paper pressure bar 4 are determined.

As described above, by establishing rules on the basis of the know-how of skilled labors and adjusting according to a membership function, it is possible to realize an automatic and equal adjustment.

Figure 15:
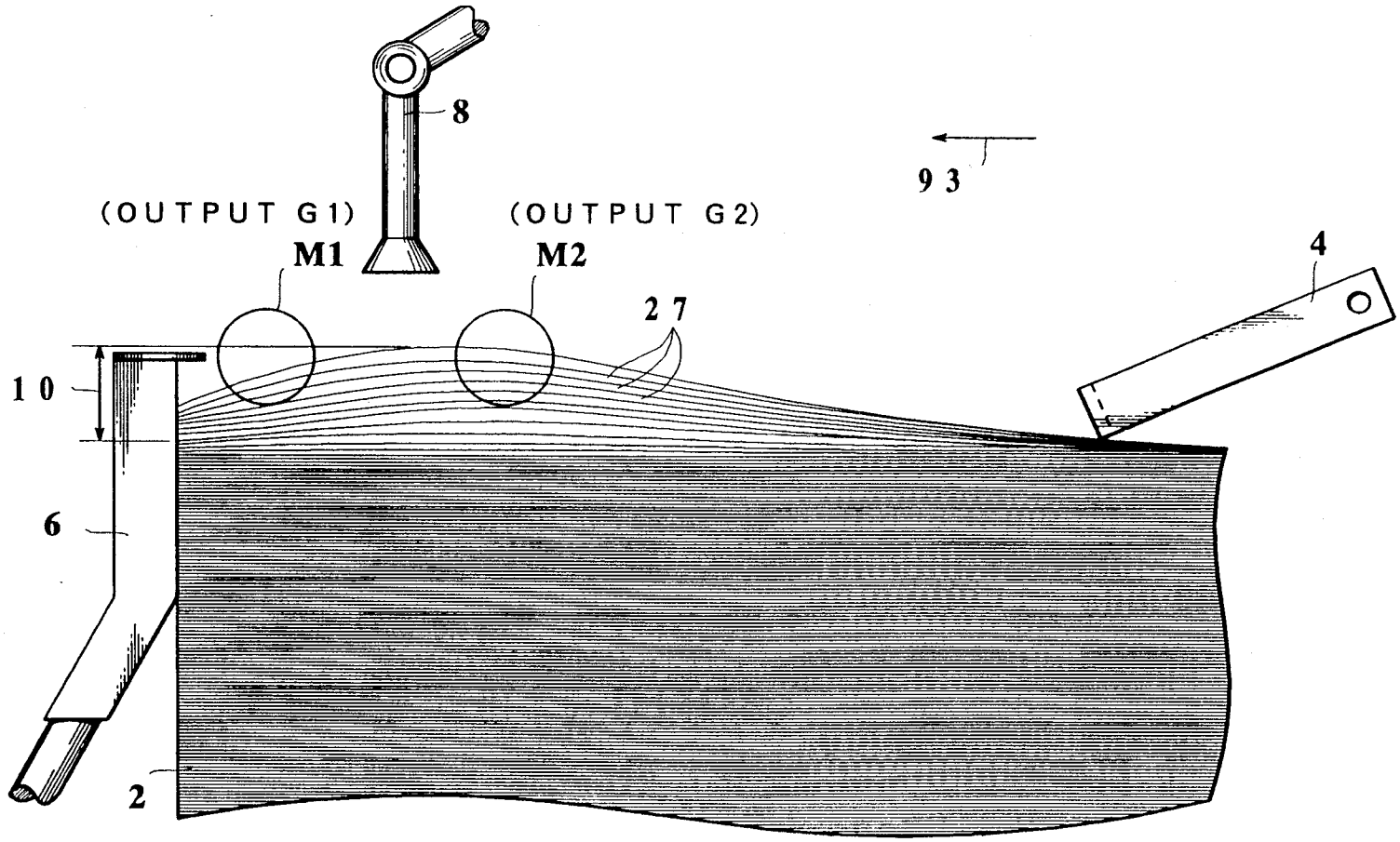
FIG. 15 is a side view showing the floating state of curled printing sheets.

As shown in FIG. 15, printing sheets 27 sometimes curve in a curly form due to, for example, sheet property, or the effect of printing ink parched after they are subjected to printing. In such a case, the absorption foot 8 cannot securely absorb the printing sheet 27, because the printing sheet 27 and absorption surface 8Q of the absorption foot 8 are not placed in parallel with one another. Further, parallelism in this case cannot be readily corrected by adjusting injection air quantity alone. If the present embodiment, which adjusts injection air quantity and the position of the paper pressure bar 4 according to the fuzzy control, is applied to such a case, an effective adjustment may be realized.

In a case where printing sheets 27 curl, the floating height of printing sheets 27 (output G1) is extremely low in the detection area Ml, whereas that (output G2) is extremely high in the detection area M2. In such a case, inference is affected by following rules.

if G1=NL and G2=PL then V=PL <7> if G1=NL and G2=PL then L=NL <8>

Figure 16:
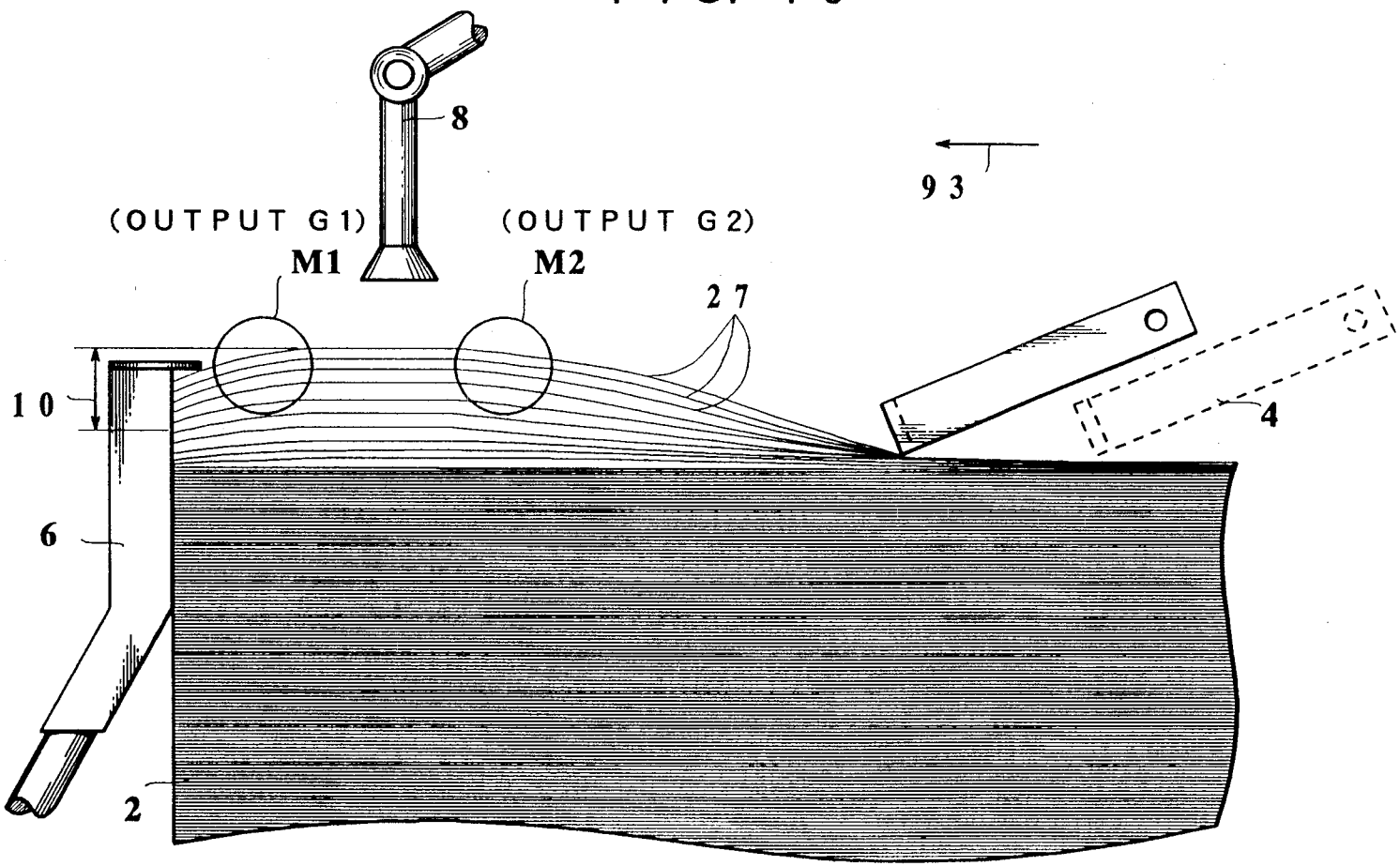
FIG. 16 is a side view showing the state in which the paper pressure bar in FIG. 15 is moved forward.

Owing to the rules <7>and <8>, injection air quantity is made to increase in large quantities, and at the same time, the paper pressure bar 4 is made to move forward greatly. FIG. 16. shows the adjusted state. In this way, it is also possible to adjust curled printing sheets 27 readily and properly. Although printing sheets 27 shown in FIGS. 15 and 16 curl downward, rules may be established and stored for the case where they curl upward. In such a case, by slightly reducing injection air quantity, and at the same time, greatly moving the paper pressure bar 4 backward, it is possible to correct the parallelism of printing sheets 27.

In the embodiment described above, a sheet feeder for an universal feeder type press is described, but the present invention may be used in a stream feeder press. Further, reflection type photoelectric sensors 21 and 22 may be substituted for by, for example, capacitance sensors or the like so long as they can detect the number of floating separate printing sheets 10. Moreover, in each embodiment described above, outputs G1 and G2 are given at the moment when a detection start signal from the proximity switch 72 is input (FIG. 5 step 22, FIG. 10 step S22). However, adjustment may be performed on the basis of an output value output from a predetermined rotational section or a mean value of entire output values output in the course of single-rotation.

In the sheet feeder for a sheet-fed press according to the present invention, printing sheets constituting the upper part of the bundle are automatically forced to float and separate in an optimum state without manual adjustment. Accordingly, it is possible to relieve defective feeding or the like, and furthermore it is also possible to save on time for adjustment and improve labor effectiveness due to automatic adjustment.

Further, adjustment is performed by comparing the separation state sensed signal with the optimum separation state value. As a result, sheet thickness, sheet quality or the like exert no influence on sheet separation, enabling the appropriate separation state to be established at all times. Moreover, the top printing sheet 27 floated is placed almost in parallel with the contact surface of the conveyance unit. Consequently, the conveyance unit can hold the top printing sheet securely and convey it to the printing process.

Also, in the sheet feeder for a sheet-fed press according to the present invention, even in a case where printing sheets are curved in a curly form, it is possible to adjust these printing sheets so as to be placed almost in parallel with the contact surface of the conveyance unit by moving the pressure unit. Consequently, the conveyance unit can hold the top printing sheet 27 more securely when conveying it.

Although the invention has been described in its preferred form with a certain degree of particularity, it is understood that the present disclosure of the preferred form has been changed in the details of its construction and any combination and arrangement of parts ma be resorted to without departing from the spirit and the scope of the invention as hereinafter claimed.

What is claimed is:

1. A sheet feeder for a sheet-fed press, comprising:

a loading base for loading a bundle of printing sheets made up of a plurality of printing sheets piled up;

an air injection unit which injects air to thereby make an upper part of the bundle of printing sheets float up and separate;

a conveyance unit which conveys a top sheet of separate printing sheets to a printing process by holding the top sheet using a contact surface;

at least two separation state detectors which emit light beams onto at least two areas of a thick side face to sense respective reflected light beams therefrom and output corresponding separation state sensed signals, the thick side face being a side face of separate printing sheets separated by air injection and said thick side face is situated substantially in parallel with said contact surface of the conveyance unit;

an optimum separation state value storage means for storing a preset optimum separation state value of printing sheets;

an adjust means which is given said at least two separation state sensed signals and said optimum separation state value and outputs an injection air quantity adjusting signal in order that separation state sensed signals become substantially the same as the optimum separation state value; and an air injection air quantity controller which is given said injection air quantity adjusting signal and adjusts the injection air quantity from the air injection unit.

2. In a sheet feeder for a sheet-fed press according to claim 1, wherein said conveyance unit holds printing sheet by absorbing.

3. In a sheet feeder for a sheet-fed press according to claim 1, wherein said separation state detectors are photoelectric sensors.

4. In a sheet feeder for a sheet-fed press according to claim 1, wherein said separation state detectors are capacitance sensors.

5. A sheet feeder for a sheet-fed press, comprising:

a loading base for loading a bundle of printing sheets made up of a plurality of printing sheets piled up;

an air injection unit which injects air to thereby make an upper part of the bundle of printing sheets float up and separate;

a pressure unit which is placed on top of the bundle of printing sheets to apply pressure thereon, being situated almost perpendicular to a direction of the air from the air injection unit and said pressure unit is movable in such a direction that is substantially identical with that of air injection;

a conveyance unit which conveys a top sheet of separate printing sheets to a printing process by holding the top sheet using a contact surface;

at least two separation state detectors which emit light beams onto at least two areas of a thick side face to sense respective light beams therefrom and output corresponding separation state sensed signals, the thick side face being a side face of separate printing sheets separated by air injection and said thick side face is situated substantially in parallel with said contact surface of the conveyance unit;

an optimum separation state value storage means for storing a preset optimum separation state value of printing sheets;

an adjust means which is given said at least two separation state sensed signals and said optimum separation state value and outputs a pressure position adjusting signal in order that the separation state sensed signals become almost the same as the optimum separation state value; and a pressure unit travel controller which is given said pressure position adjusting signal and makes the pressure unit move in such a direction that is substantially identical with that of air injection.

6. In a sheet feeder for a sheet-fed press according to claim 5, wherein said conveyance unit holds printing sheet by absorbing.

7. In a sheet feeder for a sheet-fed press according to claim 5, wherein said separation state detectors are photoelectric sensors.

8. In a sheet feeder for a sheet-fed press according to claim 5, wherein said separation state detectors are capacitance sensors.

9. A sheet feeder for a sheet-fed press, comprising:

a loading base for loading a bundle of printing sheets made up of a plurality of printing sheets piled up;

an air injection unit which injects air to thereby make an upper part of the bundle of printing sheets float up and separate;

a pressure unit which is placed on top of the bundle of printing sheets to apply pressure thereon, being situated almost perpendicular to a direction of the air from the air injection unit and said pressure unit is movable in such a direction that is substantially identical with that of air injection;

a conveyance unit which conveys a top sheet of separate printing sheets to a printing process by holding the top sheet using a contact surface;

at least two separation state detectors which emit light beams onto at least two areas of a thick side face to sense respective reflected light beams therefrom and output corresponding separation state sensed signals, the thick side face being a side face of separate printing sheets separated by air injection and said thick side face is situated substantially in parallel with said contact surface of the conveyance unit;

an adjust means which executes fuzzy inference on the basis of said at least two separation state sensed signals and outputs an injection air quantity adjusting signal and a pressure position adjusting signal in order that printing sheets are made to separate in an optimum state;

an injection air quantity controller which is given said injection air quantity adjusting signal and adjusts the injection air quantity from the air injection unit; and a pressure unit travel controller which is given said pressure position adjusting signal and makes the pressure unit move in such a direction that is substantially identical with that of air injection.

10. In a sheet feeder for a sheet-fed press according to claim 9, wherein said conveyance unit holds printing sheet by absorbing.

11. In a sheet feeder for a sheet-fed press according to claim 9, wherein said separation state detectors are photoelectric sensors.

12. In a sheet feeder for a sheet-fed press according to claim 9, wherein said separation state detectors are capacitance sensors.

* * * * *